US012668976B2

(12) United States Patent
Brandenburg

(10) Patent No.: US 12,668,976 B2
(45) Date of Patent: Jun. 30, 2026

(54) GENERATOR ENCLOSURE

(71) Applicant: Kohler Co., Kohler, WI (US)

(72) Inventor: Billy Brandenburg, Horicon, WI (US)

(73) Assignee: Discovery Energy LLC, Kohler, WI (US)

( * ) Notice: Subject to any disclaimer, the term of this patent is extended or adjusted under 35 U.S.C. 154(b) by 195 days.

(21) Appl. No.: 18/099,575

(22) Filed: Jan. 20, 2023

(65) Prior Publication Data

US 2023/0235567 A1 Jul. 27, 2023

Related U.S. Application Data

(60) Provisional application No. 63/301,709, filed on Jan. 21, 2022.

(51) Int. Cl.
*E04F 13/08* (2006.01)
*E04H 5/02* (2006.01)

(52) U.S. Cl.
CPC ..... *E04F 13/08* (2013.01); *E04H 5/02* (2013.01)

(58) Field of Classification Search
CPC .. E04F 13/00; E04F 13/08; E04H 5/00; E04H 5/02; E04H 5/04; E04H 5/06; E04H 5/08; E04H 6/00; E04H 7/00; E04H 9/00
See application file for complete search history.

(56) References Cited

U.S. PATENT DOCUMENTS

| | | | | |
|---|---|---|---|---|
| 5,927,039 | A * | 7/1999 | De Boer | E06B 1/62 403/402 |
| 6,016,634 | A | 1/2000 | Sayer | |
| 7,874,121 | B1 * | 1/2011 | Hohmann, Jr. | B32B 27/065 52/62 |
| 8,561,357 | B2 | 10/2013 | Teodorovich | |
| 9,163,450 | B2 * | 10/2015 | Messenger | E06B 7/14 |
| 9,909,352 | B2 * | 3/2018 | Norwood | E06B 7/14 |
| 10,161,179 | B2 * | 12/2018 | Norwood | E06B 1/36 |
| 10,273,741 | B1 * | 4/2019 | Summy | E06B 1/62 |
| 11,142,941 | B2 * | 10/2021 | Summy | E06B 1/62 |
| 11,933,098 | B1 * | 3/2024 | Bernhagen | E06B 1/6069 |
| 2006/0101726 | A1 * | 5/2006 | Collins | E06B 1/702 52/61 |
| 2007/0214738 | A1 * | 9/2007 | Koessler | E06B 1/62 52/302.6 |
| 2010/0251643 | A1 * | 10/2010 | Rosende | E06B 1/62 52/204.2 |
| 2014/0250801 | A1 * | 9/2014 | Knollmeyer | E06B 1/62 52/58 |
| 2015/0059258 | A1 * | 3/2015 | Norwood | E06B 1/62 52/58 |
| 2015/0076980 | A1 | 3/2015 | Robinson et al. | |

* cited by examiner

*Primary Examiner* — Chi Q Nguyen
(74) *Attorney, Agent, or Firm* — The Belles Group, P.C.

(57) ABSTRACT

A generator enclosure includes a door frame and an enclosure panel with integrated flashing having a first vertical portion, a second vertical portion, and a horizontal portion extending from the first vertical portion to the second vertical portion. The horizontal portion may abut the door frame and the second vertical portion may extend below a top portion of the door frame.

15 Claims, 11 Drawing Sheets

GENERATOR ENCLOSURE

This application claims priority benefit of Provisional Application No. 63/301,709 filed Jan. 21, 2022, which is hereby incorporated by reference in its entirety.

FIELD

This disclosure relates in general to an outdoor enclosure, and in some examples, an outdoor enclosure for an engine-generator.

BACKGROUND

Generators are used in a variety of applications to provide electrical power when power from a power grid is unavailable or not wanted. Generators may be used in both commercial and residential settings. In both instances the generator may be placed outside of a building structure in an external generator enclosure that is exposed to weather elements such as wind, rain, and snow. Over time problems may arise related to leaks or other damage to the generator enclosure related to the weather elements.

BRIEF DESCRIPTION OF THE DRAWINGS

Exemplary embodiments are described herein with reference to the following drawings.

DETAILED DESCRIPTION

The following description and the drawings illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Described herein are apparatuses, systems, and methods including a generator enclosure panel having integrated flashing. For example, the present disclosure describes generator enclosure panels having integrated flashing, generator enclosures including one or more panels having integrated flashing and methods of assembling a generator enclosure including one or more panels having integrated flashing. In some examples, the integrated flashing may be disposed at or near a bottom end of the panel. The integrated flashing may be configured to and/or cover a gap, seam, opening, crevice, or the like in a generator enclosure. The integrated flashing may be impervious to water and protect the enclosure from water such as rain, snow, melting ice, and other weather elements.

Enclosure panels including integrated flashing may improve the manufacturability of generator enclosures. Specifically, enclosures panels with integrated flashing may eliminate the need for discrete flashing reducing the number of components and steps required to assemble a generator enclosure. Further, generator enclosures including one or more panels having integrated flashing may be more impervious or water-resistant than generator enclosures including discrete flashing. For example, the use of flashing integrated with one or more enclosure panels may reduce the number of water resistant connections in the generator enclosure and thus reduce the likelihood of failure of a water resistant connection.

In some examples, enclosure panels including integrated flashing may be provided adjacent to various structures within a wall of the generator enclosure. For example, enclosure panels including integrated flashing may be provided adjacent to doors, windows, vents, and the like included in a wall of the generator enclosure. The integrated flashing may be provided or configured to direct liquids such as water, including rain, snow, and melting ice away from the various structures (e.g., doors, windows, vents) in the generator enclosure. The integrated flashing may direct water to the sides of and/or in front (and away from) the various structures in the generator enclosure.

Figure 1:
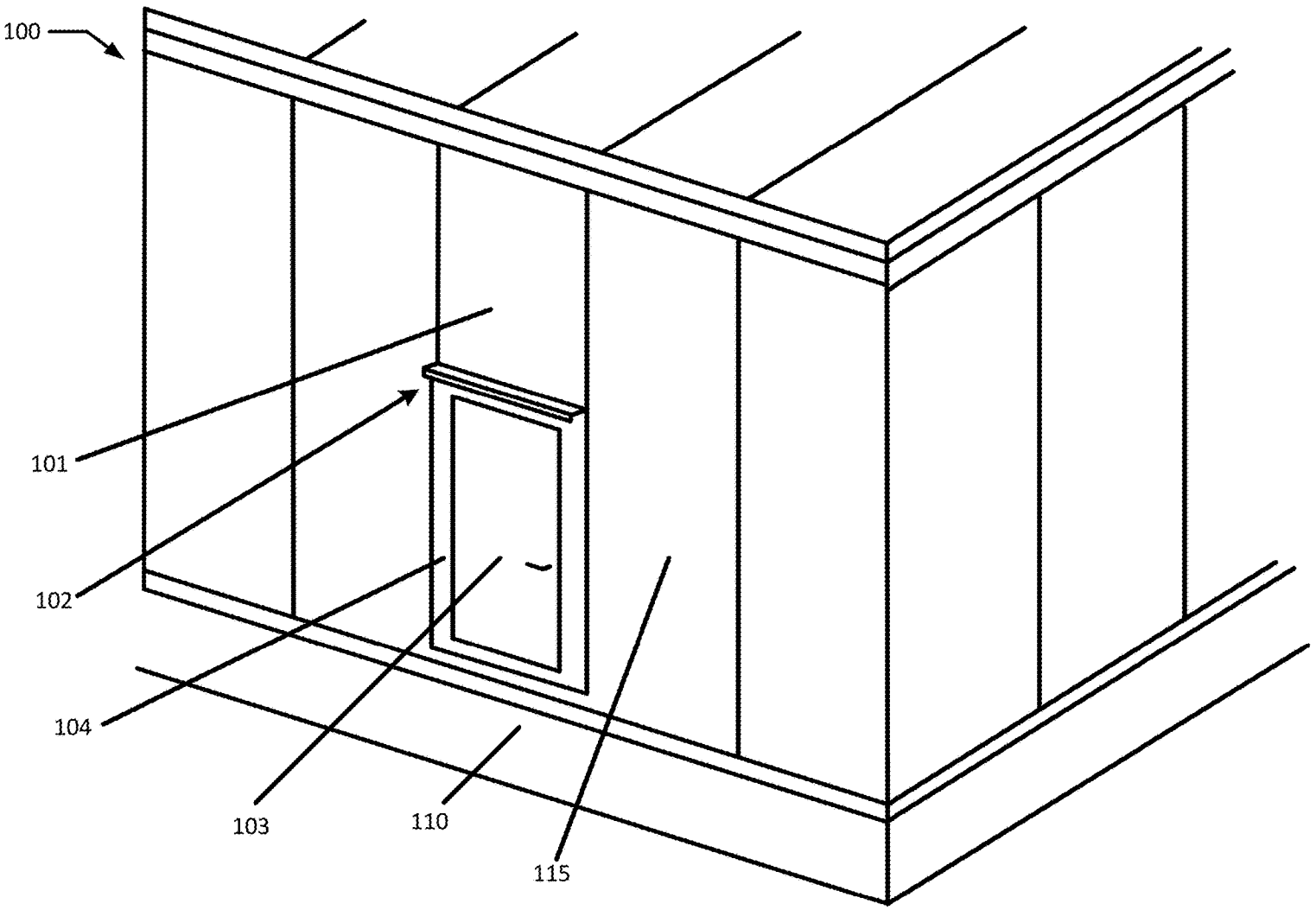
FIG. 1 illustrates a perspective view of a generator enclosure including a door and an enclosure panel with integrated flashing.

Referring to FIG. 1, a perspective view of a generator enclosure 100 including an enclosure panel with integrated flashing is shown. The enclosure panel including integrated flashing may be a front drip panel 101. The front drip panel 101 may be formed of a flashing material that is impervious to water or other liquids. Liquids such as water may be directed by the front drip panel 101 away from the generator enclosure 100.

As shown in FIG. 1, in some examples, the generator enclosure 100 may include a door 103 providing access to an interior of the generator enclosure 100. The generator enclosure 100 may include a front drip panel 101 adjacent to the door 103. In some examples, a front drip panel 101 may be disposed above the door 103. The front drip panel 101 may direct liquids such as water away from the door 103 and any crevices, openings, vents, or hardware associated with the door 103.

Further, as illustrated in FIG. 1, the door 103 may be surrounded on all four sides of the door perimeter by a door frame 104. The door frame 104 may be metal, plastic, wood, or another material. In some examples, the door frame 104 may not be water resistant and/or not impervious to water. The door frame may include a latch or coupling mechanism for securing the door 103 to the door frame 104. The door 103 may include one or more hinges so that the door 103 pivots with respect to the door frame 104.

Figure 2:
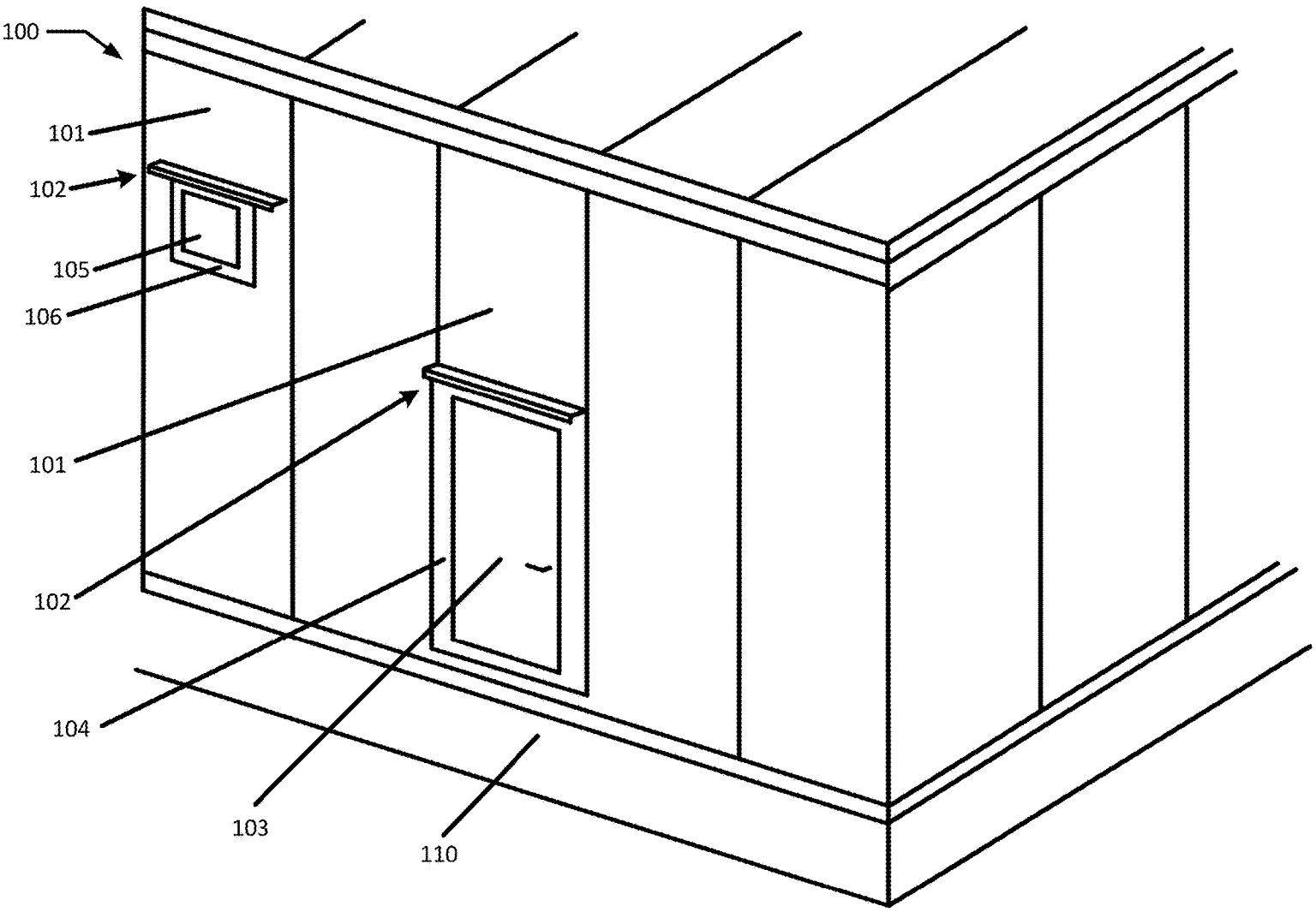
FIG. 2 illustrates a perspective view of a generator enclosure including a window and an enclosure panel with integrated flashing.

In some examples, as illustrated in FIG. 2, the generator enclosure 100 may further include a window 105. In examples including a window 105, the generator enclosure 100 may include a front drip panel 101 adjacent to (e.g., above) the window 105. The front drip panel 101 may direct liquids such as water away from the window and any crevices, openings, vents, or hardware associated with the window.

Further, as illustrated in FIG. 2, the window may be surrounded on all four sides of the window perimeter by a window frame 106. The window frame 106 may be metal, plastic, wood, or another material. In some examples, the window frame 106 may not be water resistant and/or not impervious to water. The window frame 106 may include a latch, slide, or another coupling mechanism for securing the window 105 to the window frame 106. In some examples, the window 105 may slide horizontally or vertically within the window frame to open and/or close. In other examples, the window may include one or more hinges so that window 105 may pivot with respect to the window frame 106.

Figure 3:
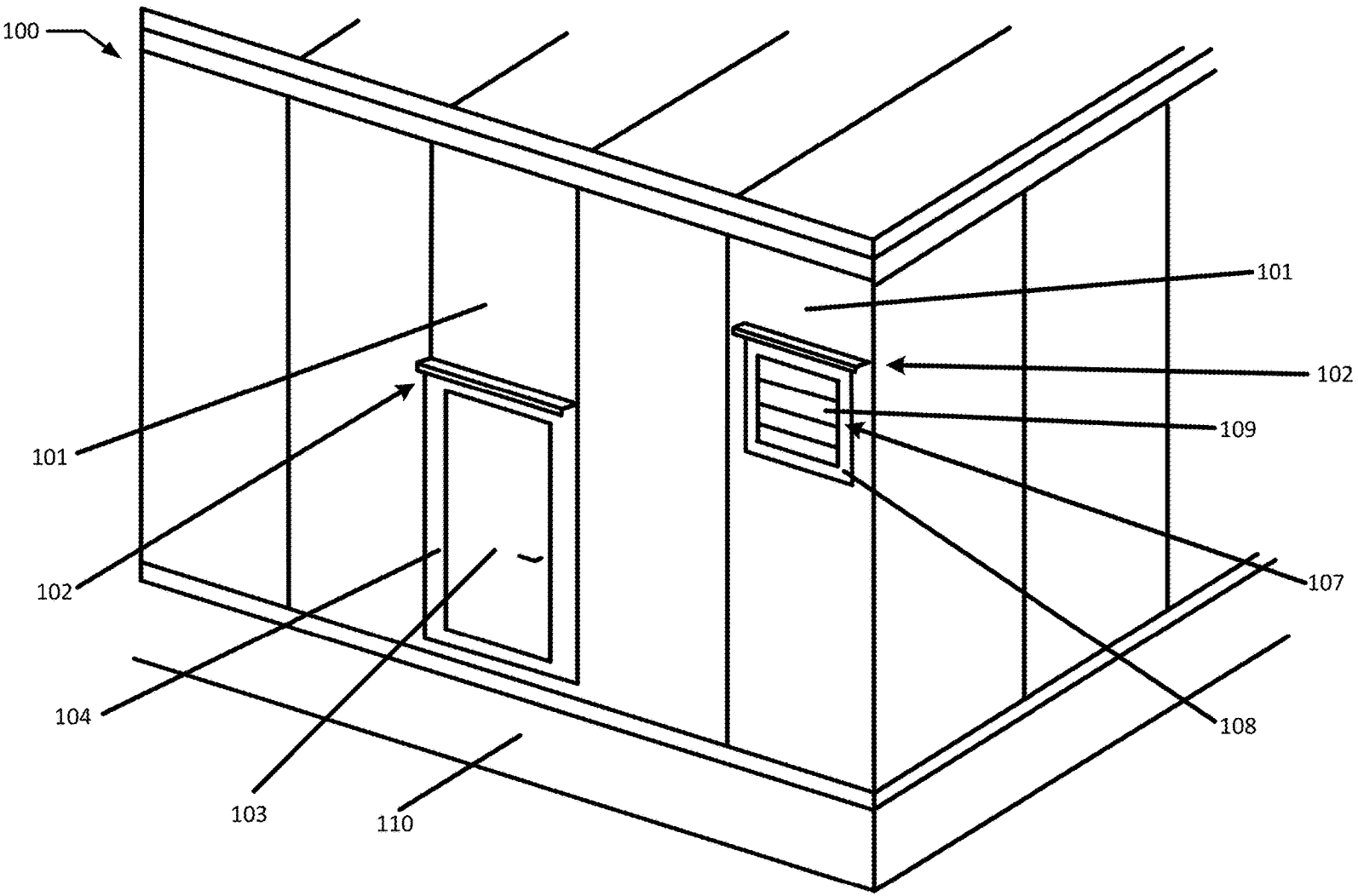
FIG. 3 illustrates a perspective view of a generator enclosure including a louver vent assembly and an enclosure panel with integrated flashing.

Further, in some examples, as illustrated in FIG. 3, the generator enclosure may include a vent assembly 107 to intake and/or exhaust gas from the generator enclosure 100. In some examples, as illustrated in FIG. 3, the vent assembly may be a louver vent assembly 107. In other examples different types of vents such as a hooded vent may be used. It should be noted that in some examples, the generator enclosure 100 may include both a window 105 and a vent assembly 107. Further, it should be understood that in some examples, the generator enclosure 100 may include a vent assembly 107 without including a door 103.

The size and shape of the vent assembly, specifically, a louver vent assembly 107, may vary depending on the application including the size of the generator and/or the generator enclosure 100. In some examples, as illustrated in FIG. 3, a generator enclosure 100 may include a relatively small louver vent assembly 107 disposed or installed in a wall or panel of the generator enclosure 100. In other examples, as illustrated and described hereinafter with respect to FIG. 4, the generator enclosure 100 may include a relatively large louver vent assembly 107 comprising an entire or the majority of a wall of the generator enclosure 100.

In some examples, for example, in the case of a relatively small louver vent assembly 107 as illustrated in FIG. 3, a front drip panel 101 may be disposed adjacent to the louver vent assembly 107. For example, a front drip panel 101 may be disposed above the louver vent assembly 107. The front drip panel 101 may direct liquids such as water away from the louver vent assembly 107 and any crevices, openings, vents, or hardware associated with the louver vent assembly 107. In other examples, for example, when the generator enclosure 100 includes a relatively large louver vent assembly 107, a front drip panel 101 may not be provided adjacent to the louver vent assembly.

Further, as illustrated in FIG. 3, a louver vent assembly 107 may be surrounded on all four sides of the perimeter of the louver vent assembly 107 by a vent frame 108. The configuration of the louver vent assembly 107 may vary. For example, in some examples, the louver vent assembly 107 may include a single louver 109 configured to rotate relative to the vent frame 108. In other examples, the louver vent assembly 107 may include a plurality of louvers 109 configured to rotate relative to the vent frame 108. The louver vent assembly 107 may include any number of louvers 109. The louver(s) 109 of the louver vent assembly 107 may rotate relative to the vent frame 108 allowing air to flow into and/or out of the generator enclosure 100. In some examples, the generator enclosure 100 may include vent assemblies (e.g., louver vent assemblies 107) in pairs with a first vent assembly being configured to intake air and a second vent assembly configured to exhaust air.

Referring to FIGS. 1-3, the front drip panel 101 includes a water shield implemented by the integrated flashing 102. The integrated flashing 102 protects the door frame 104, window frame 106, and/or the vent frame 108 frame water such as rain, snow, melting ice, and other weather elements. The water shield or integrated flashing 102 extends in at least one direction away from the main portion of the front drip panel 101. As shown in FIGS. 1-3, the front drip panel 101 is generally vertical (e.g., in a direction parallel to the direction of gravity) and the water shield 102 extends horizontally from the main portion of the front drip panel 101.

The front drip panel 101 includes a water shield, implemented by the integrated flashing 102, that protects the vent frame 108 from water such as rain, snow, melting ice, and other weather elements. The water shield 102 extends in at least one direction away from the main portion of the front drip panel 101. As shown in FIG. 1, the front drip panel 101 is generally vertical (e.g., in a direction parallel to the direction of gravity) and the water shield 102 extends horizontally from the main portion of the front drip panel 101.

In some examples, the generator enclosure 100 may include an opening other than a door 103, window 105, or vent assembly. For example, the generator enclosure 100 may include a top access opening 130 (see FIG. 4) configured to receive one or more electric cables connected to the engine-generator and a front drip panel 101 adjacent to the top access opening 130. A front drip panel 101 may direct liquids such as water away from any type of opening, seam, crevice, vent, hardware, or the like in the generator enclosure 100.

Figure 4:
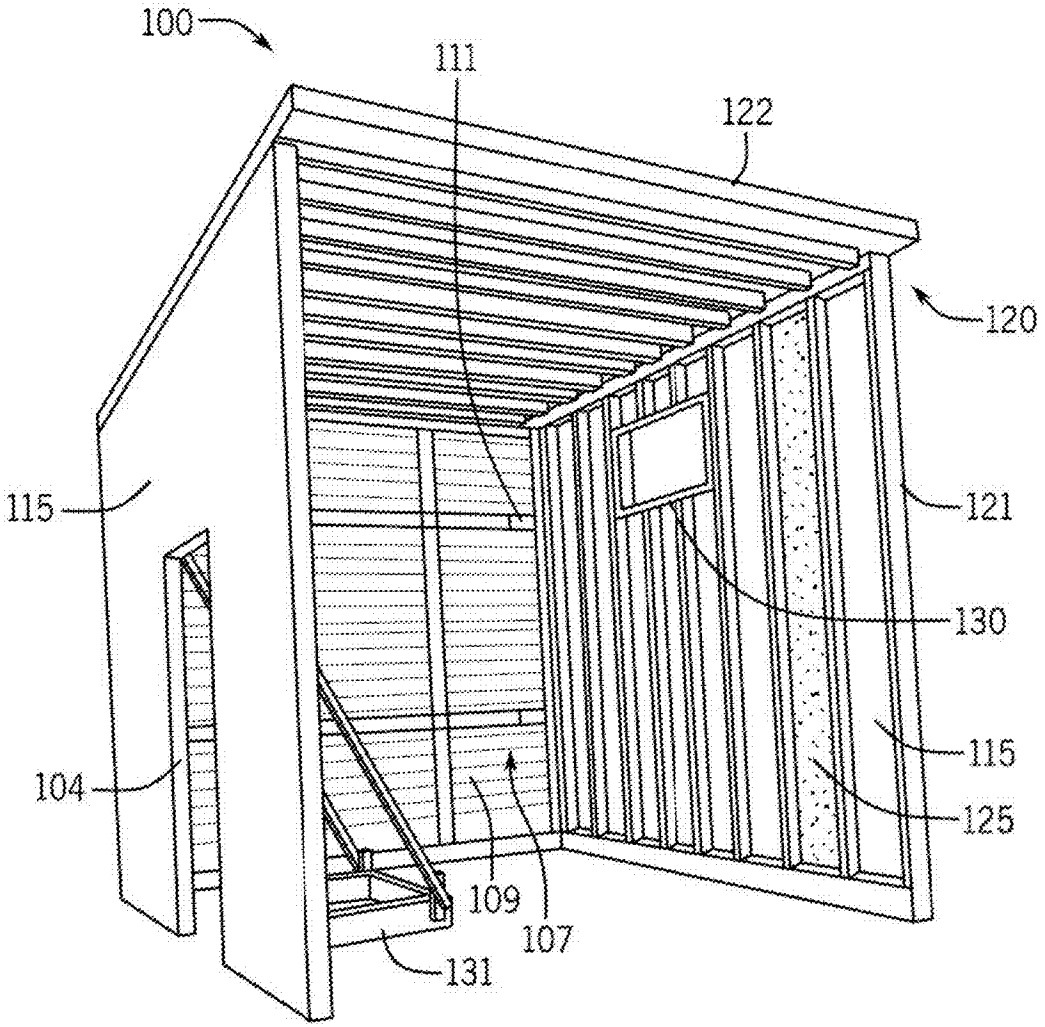
FIG. 4 illustrates a partial cross-sectional view of the generator enclosure of FIG. 1 including a supporting frame.

FIG. 4 illustrates a partial cross-sectional view of the generator enclosure 100 including a supporting frame 120. The supporting frame 120 may be comprised of vertical columns 121 and horizontal beams 122. The columns 121 and beams 122 may be attached or connected to one another form a structural frame (e.g., supporting frame 120) to which a front drip panel 101 and/or adjacent panels 115 may be attached or secured. In some examples, the columns 121 and beams 122 may be welded to one another to form the supporting frame 120. In other examples, an adhesive such as foam tape may attach or connect the columns 121 and beams 122 to form the supporting frame. In other examples, fasteners may be used to attach or connect the columns 121 and the beams 122 to form the supporting frame 120. Example fasteners include rivets, screws, bolts, or other devices. Any combination of welding, adhesives, and/or fasteners may be used to attach or connect the columns 121 and beams 122.

The shape of the plurality of vertical columns 121 and horizontal beams 122 may vary. For example, the columns 121 and beams 122 may be rectangular, round, or any other suitable shape. In some examples, the columns 121 and beams 122 may be hollow. The plurality of vertical columns 121 and/or plurality of horizontal beams 122 may be comprised of various materials such as plastics, aluminum, copper, stainless steel, or alloys. In some examples, the columns 121 and beams 122 may be an aluminum rectangular hollow cross section.

In some examples, the generator enclosure 100 may include insulation 125 disposed on an interior surface of the one or more panels (e.g., front drip panel 101, adjacent panels 115) and/or between columns 121. The insulation may be heat resistant sound insulation.

Further, FIG. 4 illustrates (a relatively large) louver vent assembly 107. As illustrated in FIG. 4, the louver vent assembly 107 is disposed along an entire wall of the generator enclosure 100. In some examples, a louver vent assembly 107 may be provided on both of opposite walls of the generator enclosure 100 such that one louver vent assembly 107 may be an inlet through which air is drawn into the generator enclosure 100 and another louver vent assembly 107 may be an outlet through which air within the generator enclosure 100 is exhausted. Each of the louvers 109 in the louver vent assembly may be rotatably coupled to a vent frame 108 and/or the generator enclosure (e.g., vertical columns 121). For example, each of the louvers 109 may be rotatably connected at or near a top of the louver 109.

In some examples, a motor 111 (e.g., an electric motor) may be mechanically coupled to the louvers 109 of the louver vent assembly 107 to open or close the louvers. For example, the motor 111 may open the louvers 109 during operation of an engine-generator within the generator enclosure 100. In other examples, the weight of each louver 109 and/or a weight disposed at a bottom of each louver 109 may cause the louvers to remain in a closed (e.g., vertical) state when the engine-generator is not operating; however, during operation of the engine-generator a pressure created by the fan may open the louvers 109 allowing air to flow into and/or out of the generator enclosure 100. In some examples, the louvers may open into the generator enclosure 100. In other examples, the louvers may open outside (e.g., to an exterior of the generator enclosure 100). In some examples, the generator enclosure 100 may include louvers 109 that both open into and out of the generator enclosure 100.

During operation of the engine-generator set, a fan such as a radiator fan attached to a drive shaft of the engine may create a vacuum within the generator enclosure as it evacuates air from the generator enclosure 100. Low pressure occurring in the generator enclosure 100 during operation of an engine-generator may increase the likelihood that liquids such as water are drawn into the generator enclosure 100 through one or more openings, crevices, seams, or the like between the front drip panel 101, adjacent panels 115, door frames 104, window frames 106, vent frames 108, and the like. However, the front drip panel 101, specifically, the integrated flashing 102 of the front drip panel 101 may cover openings, crevices, seams, and the like between the front drip panel 101 and the adjacent panels 115, door frame 104, window frame 106, vent frame 108, top access opening 130, and the like preventing water from being drawn into the generator enclosure 100.

Figure 5:
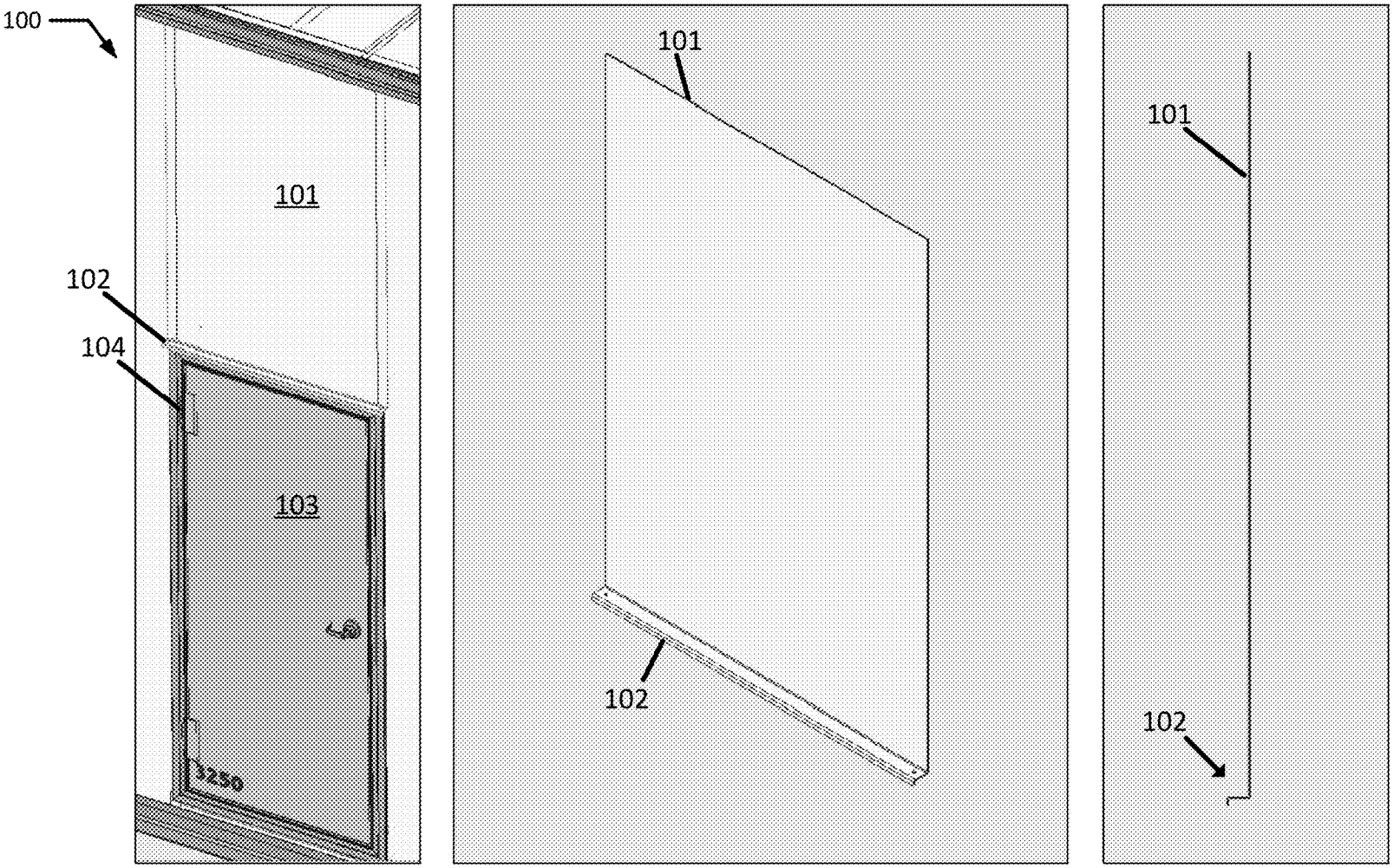
FIG. 5 illustrates an example of an enclosure panel with integrated flashing.

Referring to FIG. 5, a front drip panel 101 with integrated flashing 102 is illustrated. The front drip panel 101 may be formed of a flashing material that is impervious to water or other liquids. The front drip panel 101 may be comprised of various materials such as plastic, rubber, aluminums, copper, stainless steel, or alloys. In some examples, a water resistant and/or oxidation resistant coating may be applied to an outer surface of the front drip panel 101. In some examples, paint may be applied to an outer surface of the front drip panel. The front drip panel 101 may be wind resistant and/or sound resistant. As described above with respect to FIGS. 1-3, the front drip panel 101 includes integrated flashing 102 configured to protect a door frame 104, window frame 106, vent frame 108, or any other frame or structure disposed within a wall of the generator enclosure 100 from water such as rain, snow, melting ice, and other weather elements.

As illustrated in FIG. 5, the integrated flashing 102 may be located at or near a bottom of the front drip panel 101. The integrated flashing 102 may extend in at least one direction away from the main portion of the front drip panel 101. As shown in FIG. 5, the front drip panel 101 is generally vertical (e.g., in a direction parallel to the direction of gravity) and the water shield 102 extends horizontally from the main portion of the front drip panel 101. Further, as illustrated in FIG. 5, the front drip panel 101 may overlap the at least one of the plurality of adjacent panels. That is, the front drip panel 101 may be placed over the supporting frame 120. The front drip panel 101 may be coupled to the supporting frame 120. In addition, the front drip panel 101 may overlap adjacent panels 115. That is, the front drip panel 101 may be placed over a seam between the supporting frame 120 and the adjacent panel 115. The front drip panel 101 may be adhered to both the supporting frame 120 and the adjacent panel 115 on opposite sides of the seam.

Figure 6:
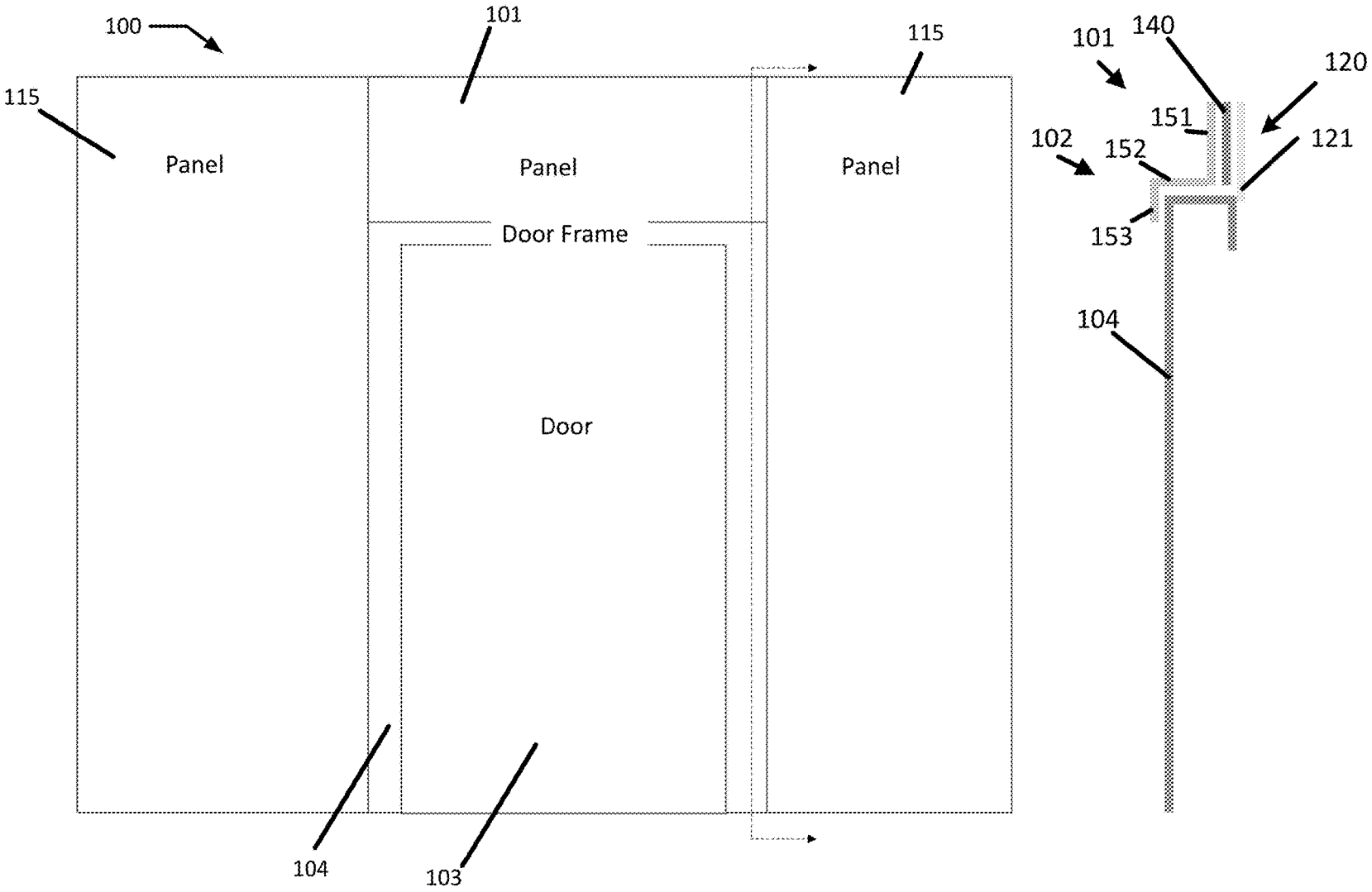
FIG. 6 illustrates an example generator enclosure including a door frame and an enclosure panel with integrated flashing.

Referring to FIG. 6, the generator enclosure 100 may include a plurality of adjacent panels 115 adjacent to a front drip panel 101, door 103, window 105, and/or vent assembly. In some examples, the adjacent panels 115 may have a different water impermeability than the front drip panel 101. In other examples, the adjacent panels 115 may have the same water impermeability as the front drip panel 101. The adjacent panels 115 may be comprised of various materials such as plastic, rubber, aluminum, copper, stainless steel, or alloys. In some examples, the adjacent panels 115 may be comprised of the same material as the front drip panel 101. In other examples, the adjacent panels 115 may be comprised of a different material than the front drip panel 101. In some examples, a water resistant and/or oxidation resistant coating may be applied to an outer surface of the adjacent panels 115. In some examples, paint may be applied to an outer surface of the adjacent panels 115. The adjacent panels 115 may be wind resistant and/or sound resistant.

Still referring to FIG. 6, a generator enclosure 100 including a door 103, a door frame 104, and a front drip panel 101 is illustrated. The door frame 104 may be attached or secured to the supporting frame 120. In some examples, the door frame 104 may be welded to the supporting frame 120. In other examples, an adhesive such as foam tape may be used to attach or secure the door frame 104 to the supporting frame 120. In other examples, fastening members may be used to attach or secure the door frame 104 to the supporting frame 120. Example fastening members include rivets, screws, bolts, or other devices. Any combination of welding, adhesive, and/or fasteners may be used to attach or secure the door frame 104 to the supporting frame 120. A window frame 106 or vent frame 108 may be attached to the supporting frame 120 using any combination of welding, adhesive, and/or fasteners. In some examples, as illustrated in FIG. 6, the door frame 104 may extend or protrude outside of the supporting frame 120. Similarly, in other examples, a window frame 106 and/or a vent frame 108 may extend or protrude outside of the supporting frame 120.

As illustrated in FIG. 6, the integrated flashing 102 may include a main portion or a first vertical portion 151, a horizontal portion 152 extending from the first vertical portion, and a second vertical portion 153. As illustrated in FIG. 6, a column 121 of the supporting frame may extend behind the front drip panel 101 and the door frame 104. The column 121 may be parallel to the first vertical portion 151 of the front drip panel 101. The first vertical portion 151 may be attached or secured to one or more columns 121 extending behind the front drip panel 101. For example, an adhesive such as foam tape 140 may be used to attach or secure the front drip panel 101, specifically, the first vertical portion 151 of the front drip panel 101 to the one or more columns 121 extending behind the front drip panel 101. In other examples, one or more fasteners may be used to attach or secure the front drip panel 101 to the one or more columns 121 extending behind the front drip panel 101. Example fasteners include rivets, screws, bolts, or other devices.

The foam tape 140 may include adhesive on two sides. The adhesive may be acrylic. The foam tape 140 may form a bond equivalent to a mechanical fastener. The acrylic core provides high adhesive forces by performing similar to a viscous liquid and an elastic solid, which may be referred to as viscoelasticity. The acrylic adhesive is configured to flow into the small pores or other irregularities of the panels. The elastic properties of the foam tape 140 allow it to absorb dynamic loads (e.g., flexing in the wind) as well as differential expansion between surfaces (e.g., in varying temperatures).

Further, as illustrated in FIG. 6, the horizontal portion 152 may abut the door frame 104. In some examples, the horizontal portion 152 may be attached or secured to the door frame 104. For example, foam tape may be used to attach or secure the horizontal portion 152 to the door frame 104. Similarly, in examples including a window frame 106 and/or vent frame 108 the horizontal portion 152 of the integrated flashing 102 may abut and be attached or secured to the window frame 106 or vent frame 108. Further, as illustrated in FIG. 6, the second vertical portion 153 of the integrated flashing 102 may extend below the top of the door frame 104. In some examples, the second vertical portion 153 may abut and/or be attached or secured (e.g., by foam tape) to the door frame 104. Similarly, in examples including a window frame 106 and/or vent frame 108 the second vertical portion 153 may extend below a top of the window frame 106 or vent frame 108. Further, the second vertical portion 153 may abut and/or be attached or secured to the window frame 106 and/or vent frame 108. In some examples, as illustrated in FIG. 6, an entire bottom surface of the horizontal portion 152 may contact the door frame 104, window frame 106, and/or vent frame 108

Figure 7:
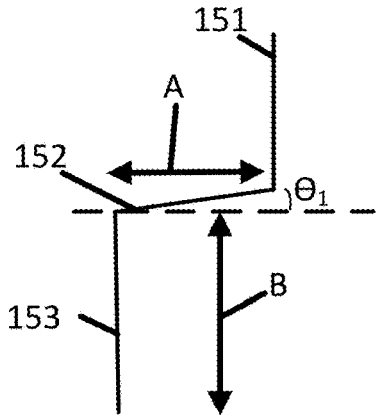
FIGS. 7-9 illustrate examples of enclosure panels with integrated flashing.
Figure 8:
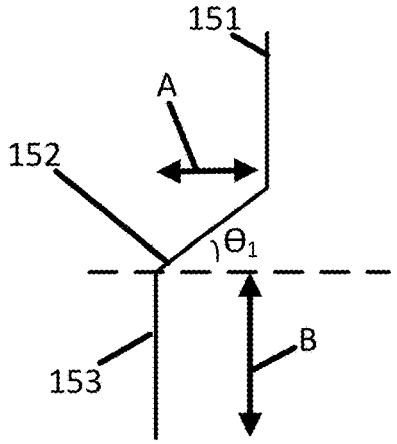
Figure 9:
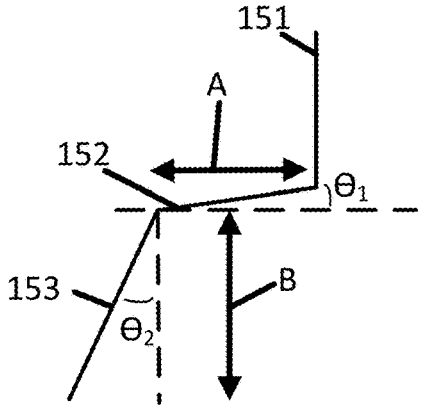

Referring to FIGS. 7-9, the components (e.g., first vertical portion 151, horizontal portion 152, second vertical portion 153) may alternatively extend from each other at angles other than 90 degrees. FIGS. 7, 8, and 9 illustrate alternative examples of a front drip panel. The first vertical portion 151, horizontal portion 152, and second vertical portion 153 may have a variety of different lengths. The first vertical portion 151 may be longer than the horizontal portion 152 and the second vertical portion 153. The first vertical portion 151 may be longer than a sum of the lengths of the horizontal portion 152 and the second vertical portion 153. In some examples, the horizontal portion 152 may be longer than the second vertical portion 153. In other examples, the second vertical portion 153 may be longer than the horizontal portion 152.

The horizontal portion 152 and the second vertical portion 153 may be placed at different angles with respect to each other and the first vertical portion 151. The horizontal distance A represents a projection of the horizontal portion 152 on a horizontal plane (e.g., a plane perpendicular to the direction of gravity). A vertical distance B represents a projection of the second vertical portion 152 on a vertical plane (e.g., a plane in the direction of gravity). In some examples, the horizontal distance A may be greater than the vertical distance B. In some examples, the vertical distance B may be greater than the horizontal distance A. In some examples, the horizontal distance A and the vertical distance B may be the same.

The horizontal distance A may vary. In some examples, the horizontal distance A may be 100 millimeters or less. In other examples, the horizontal distance A may be 50 millimeters or less. In yet other examples, the horizontal distance A may be 25 millimeters or less. In some examples the horizontal distance A may be in the range of 10 millimeters to 50 millimeters.

The vertical distance B may vary. In some examples, the vertical distance B may be 100 millimeters or less. In other examples, the vertical distance B may be 50 millimeters or less. In yet other examples, the vertical distance B may be 25 millimeters or less. In some examples the vertical distance B may be in the range of 10 millimeters to 50 millimeters.

An angle $\theta_1$ is measured from the horizontal plane as the positive angle of the horizontal portion 152 above the horizontal plane as the horizontal portion 152 meets the first vertical portion 151. The horizontal angle $\theta_1$ may vary. In some examples, horizontal portion 152 may extend along the horizontal plane such that the angle $\theta_1$ is 0 degrees. The angle $\theta_1$ may be less than 90 degrees. In some examples, the angle $\theta_1$ may be less than 60 degrees. In some examples, the angle $\theta_1$ may be less than 45 degrees. In some examples, the angle $\theta_1$ may be in the range of 15 degrees to 30 degrees. In some examples, the angle $\theta_1$ may be in the range of 5 degrees to 20 degrees. The horizontal distance A may be independent from or dependent on the angle $\theta_1$.

An angle $\theta_2$ may represent an angle between the second vertical portion 153 and a vertical plane. The vertical plane may be parallel to the direction of gravity. The vertical angle $\theta_2$ may vary. In some examples, second vertical portion 153 may extend along the vertical plane such that the angle $\theta_2$ is 0 degrees. The angle $\theta_2$ may be less than 90 degrees. In some examples, the angle $\theta_2$ may be less than 60 degrees. In some examples, the angle $\theta_2$ may be less than 45 degrees. In some examples, the angle $\theta_2$ may be in the range of 15 degrees to 30 degrees.

The front drip panel 101 may include first vertical portion 151, horizontal portion 152, and second vertical portion including any combination of lengths thereof, horizontal distances A, vertical distances B, angles $\theta_1$, and angles $\theta_2$.

In one example, as shown by FIG. 7 the angle $\theta_1$ is approximately 10 degrees, or in the range of 5-20 degrees, so that the horizontal portion 152 is slightly inclined with respect to the horizontal plane. FIG. 7 illustrates an example where the horizontal distance A is a first distance (e.g., 50 millimeters or less). The horizontal distance A may be independent from or dependent on the angle $\theta_1$.

In one example, as shown by FIG. 8 the angle $\theta_1$ is approximately 40 degrees, or in the range of 20-45 degrees, so that the horizontal portion 152 is moderately inclined with respect to the horizontal plane. FIG. 8 illustrates an example where the horizontal distance A is a second distance (e.g., 10 millimeters or more). The horizontal distance A may be independent or dependent on the angle $\theta_1$. In other examples, the angle $\theta_1$ may be approximately 60 degrees or more.

In one example, as shown by FIG. 9, both the horizontal portion 152 and the second vertical portion 153 are angled. An angle $\theta_2$ may represent an angle between the second vertical portion 153 and a vertical plane. The vertical plane may be parallel to the direction of gravity. Examples for angle $\theta_2$ may include 20 degrees or in the range of 10-80 degrees.

Figure 10:
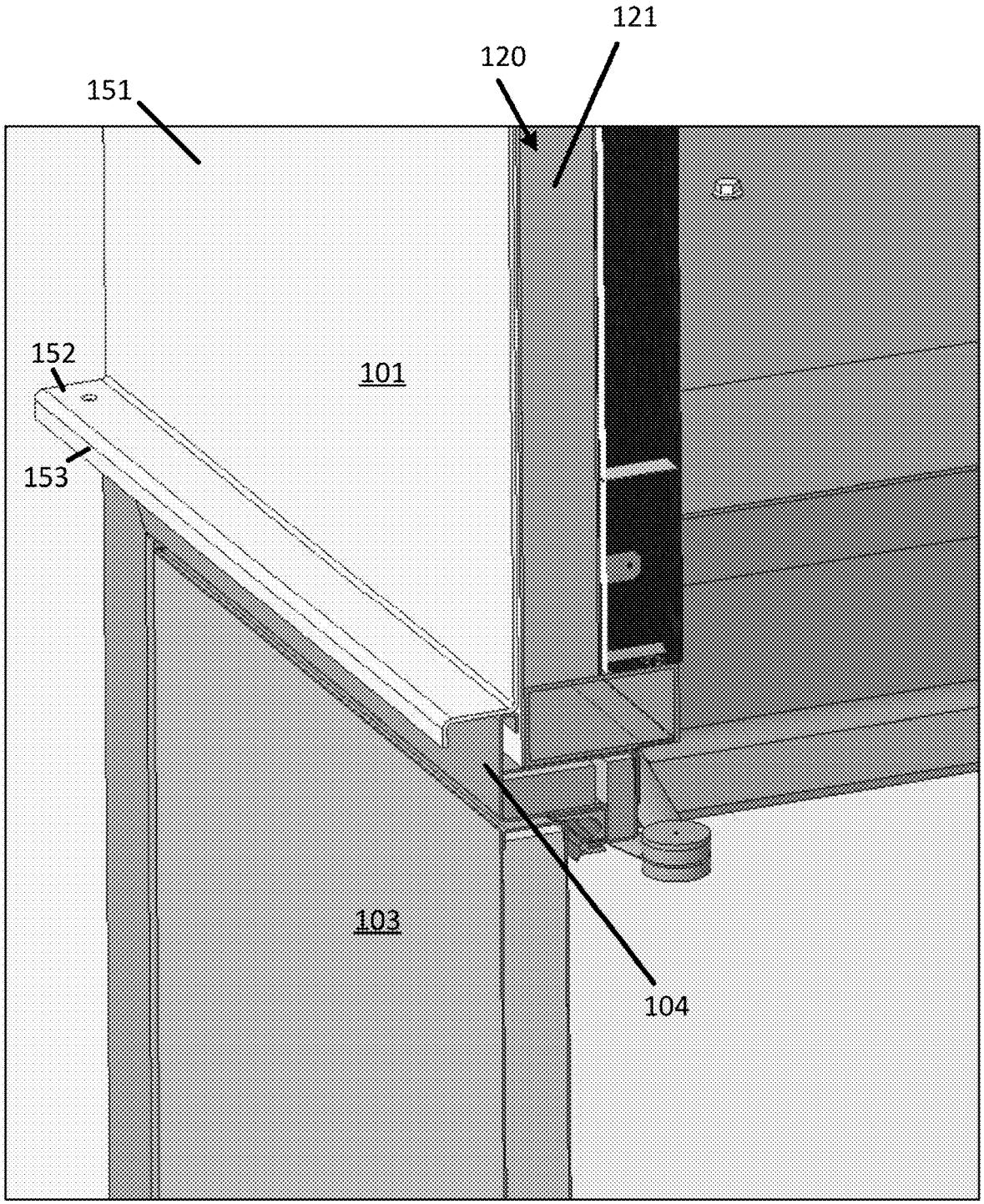
FIG. 10 illustrates an example side view of a door frame and an enclosure panel with integrated flashing.

FIG. 10 illustrates a side view of a door frame 104 and a front drip panel 101 according to the present disclosure. In some examples, as illustrated in FIG. 10, only a portion of the bottom surface of the horizontal portion 152 may abut a top surface of the door frame 104. The top surface of the door frame may be a top portion of the door frame. In other words, the horizontal portion 152 may extend or protrude outward past the door frame 104. In other examples, an entire bottom surface of the horizontal portion may abut a top surface of the door frame 104. In some examples, the horizontal portion 152 may be attached or secured to a top surface of the door frame 104. Similarly, in examples including a window frame 106 or vent frame 108 a portion of the bottom surface of the horizontal portion 152 or the entire bottom surface of the horizontal portion 152 may abut a top surface of the window frame 106 or vent frame 108. Similarly, the horizontal portion 152 may be attached or secured to a top surface of the window frame 106 or vent frame 108. For example, an adhesive, such as foam tape 140 may be used to attach or secure the horizontal portion 152 to a door frame 104, window frame 106, and/or vent frame 108.

Figure 11:
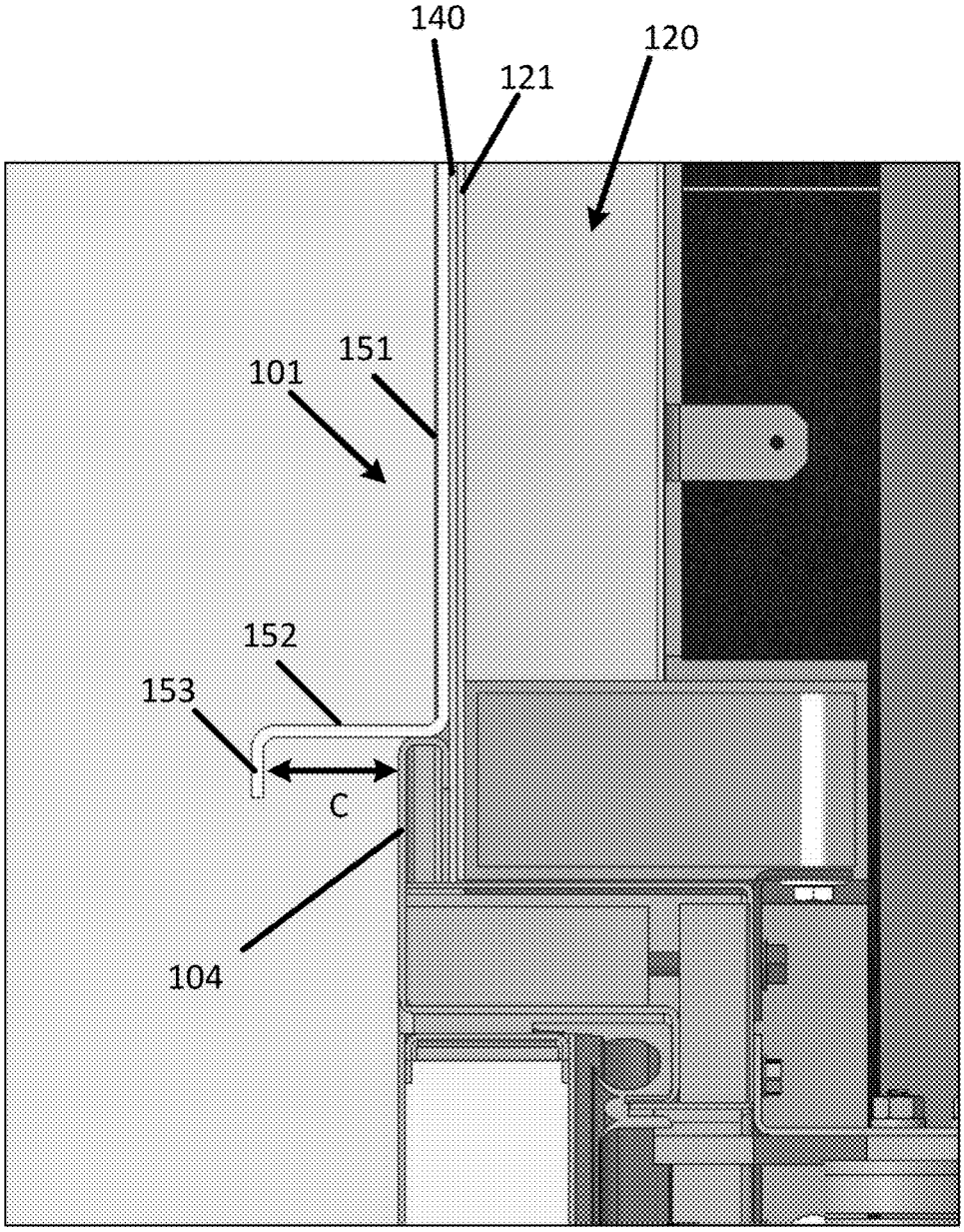
FIG. 11 illustrates another side view of a door frame and an enclosure panel with integrated flashing.

FIG. 11 illustrates a side view of a door frame 104 and a generator enclosure 100 including a front drip panel 101. As illustrated in FIG. 11, foam tape 140 may be placed or disposed between the front drip panel 101, specifically, the first vertical portion 151 of the front drip panel 101 and the supporting frame 120. The foam tape 140 may be placed or disposed on one or more columns 121 of the supporting frame 120. In some examples, the front drip panel 101 and adjacent panels 115 may have a width in a horizontal distance larger than a spacing between the one or more columns 121 in the horizontal direction. In some examples, the generator enclosure may include more than one front drip panel 101. For example, the generator enclosure may include one front drip panel 101 for each door 103, window 105, or vent assembly included in the generator enclosure 100.

FIG. 11 illustrates a horizontal distance C extending between a front or exterior surface of the door frame 104 and the second vertical portion 153. The horizontal distance C may correspond to a shortest horizontal distance between the front of the door frame 104 and the second vertical portion 153. In examples including a window frame 106 and/or a vent frame 108, the horizontal distance C may be measured from a front or exterior surface of the window frame 106 or vent frame 108 to the second vertical portion 153. In some examples, the horizontal distance C may be more than 10 millimeters. In other examples, the horizontal distance C may be in the range of 5 to 25 millimeters. In some examples, the horizontal distance C may be in the range of 5 to 50 millimeters. In some examples, the horizontal distance C may be more than 10 millimeters. In other examples, the horizontal distance C may be less than 50 millimeters.

Figure 12:
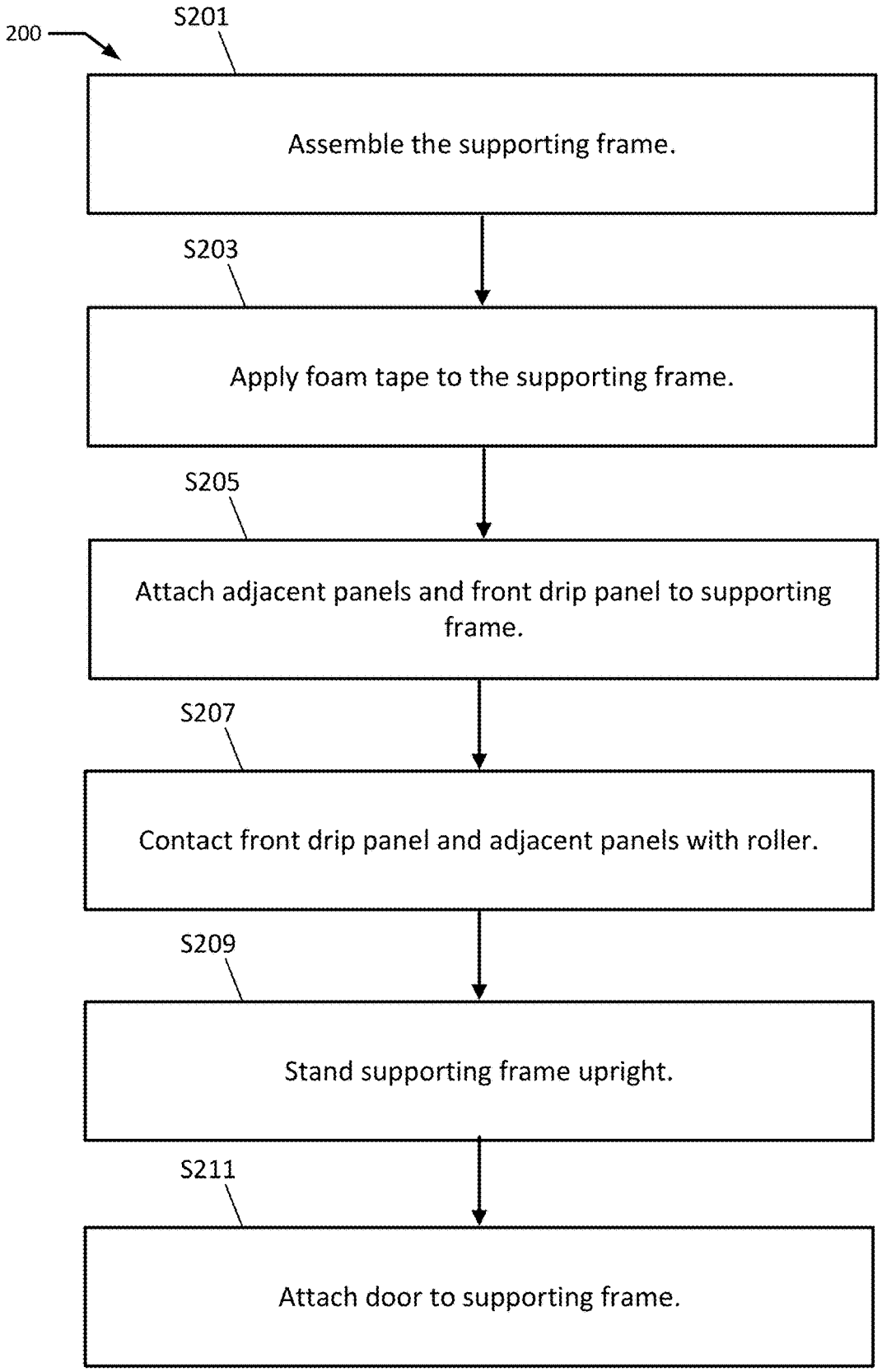
FIG. 12 illustrates a flow chart for assembling a generator enclosure including a panel with integrated flashing according to one example.

FIG. 12 illustrates a flow chart 200 for assembling a generator enclosure 100 including a front drip panel 101 with integrated flashing 102 according to a first example of the present disclosure. The flow chart 200 may be used to assemble a generator enclosure 100 according to the various examples of the present disclosure. Additional, different, or fewer acts may be provided.

In a first act S201, the supporting frame 120 may be assembled. At act S201, the plurality of columns 121 and beams 122 comprising the supporting frame 120 may be attached or connected to one another. In some examples, at act S201 individual walls of the supporting frame 120 may be assembled. For examples, columns 121 and beams forming a single wall of the generator enclosure may be attached to connected to one another. At act S201, the columns 121 and beams 122 comprising the supporting frame 120 may be welded to one another, attached or connected to one another using an adhesive such as foam tape, and/or attached or connected to one another using fasteners. Further, in act S201, one or more of a door frame 104, a window frame 106, and/or a vent frame 108 may be attached or connected to the supporting frame 120.

In a second act S203, foam tape 140 may be applied to the supporting frame 120. In some examples, at act S203, the walls of the supporting frame 120 may be separate from one another and may be laid on a horizontal surface such as a floor or the ground. In other examples, at act S203, the supporting frame 120 may be fully assembled and the walls of the supporting frame may stand vertically. At act S203 foam tape 140 is applied to the supporting frame 120. Specifically, foam tape 140 may be applied to an outer surface of columns 121 and/or beams 122 forming the supporting frame 120. In some examples, foam tape 140 may be applied to a top surface and/or an exterior surface of a door frame 104, window frame 106, and/or vent frame 108 disposed or attached to the supporting frame 120. In other examples, the foam tape 140 may be applied to the front drip panel 101 and/or the adjacent panels 115 instead of the supporting frame 120.

In a third act S205, the adjacent panels 115 and/or one or more front drip panels 101 are attached or secured to the supporting frame 120. Specifically, the adjacent panels 115 and/or front drip panel(s) 101 may be placed on the supporting frame 120 so as to contact the foam tape 140 applied to the supporting frame 120. In some examples, the adjacent panels 115 may be attached or secured to the supporting frame 120 before the front drip panel(s) 101. In some examples, for example, when a front drip panel 101 overlaps one or more adjacent panels 115, additional foam tape 140 may be applied to the portion of the exterior surface of the one or more adjacent panels that will be overlapped by the front drip panel(s). The overlapping front drip panel(s) 101 may then be attached or secured to the adjacent panels 115 and/or the supporting frame 120.

In a fourth act S207, the front drip panel(s) and adjacent panels 115 may be contacted by a roller or another mechanical device (e.g., plate, etc.). The roller or other mechanical device may apply a force to the front drip panel(s) and/or adjacent panels 115 in the direction of the supporting frame 120. A force applied by the roller or mechanical device may ensure and/or strengthen a bond (e.g., adhesion) between the supporting frame 120, foam tape 140, and the front drip panel(s) 101 and/or adjacent panels 115.

In a fifth act S209, the supporting frame including the front drip panel(s) 101 and adjacent panels 115 may be stood upright. In some examples, the supporting frame 120 may be stood upright after the foam tape 14 and front drip panel(s) 101 and adjacent panels 115 have been attached or secured to the supporting frame 120. In other examples, the supporting frame 120 may be stood upright before applying the foam tape 140 and/or attaching or securing the adjacent panels 115 and front drip panel(s) 101.

In a sixth act S211, a door 103, window 105, and/or vent assembly may be attached or secured to the supporting frame 120. Specifically, a door 103 may be attached or secured to a door frame 104 of the supporting frame 120, a window 105 may be attached or secured to a window frame 106 of the supporting frame 120, and/or a vent assembly may be attached or secured to a vent frame 108 of the supporting frame 120. Each of the door 103, window 105, and/or vent assembly may be plumbed (e.g., aligned with a vertical axis) before being attached or secured to the supporting frame. Further, in some examples, in act S211, one or more walls of the supporting frame 120 may be attached or connected to one another.

Figure 13:
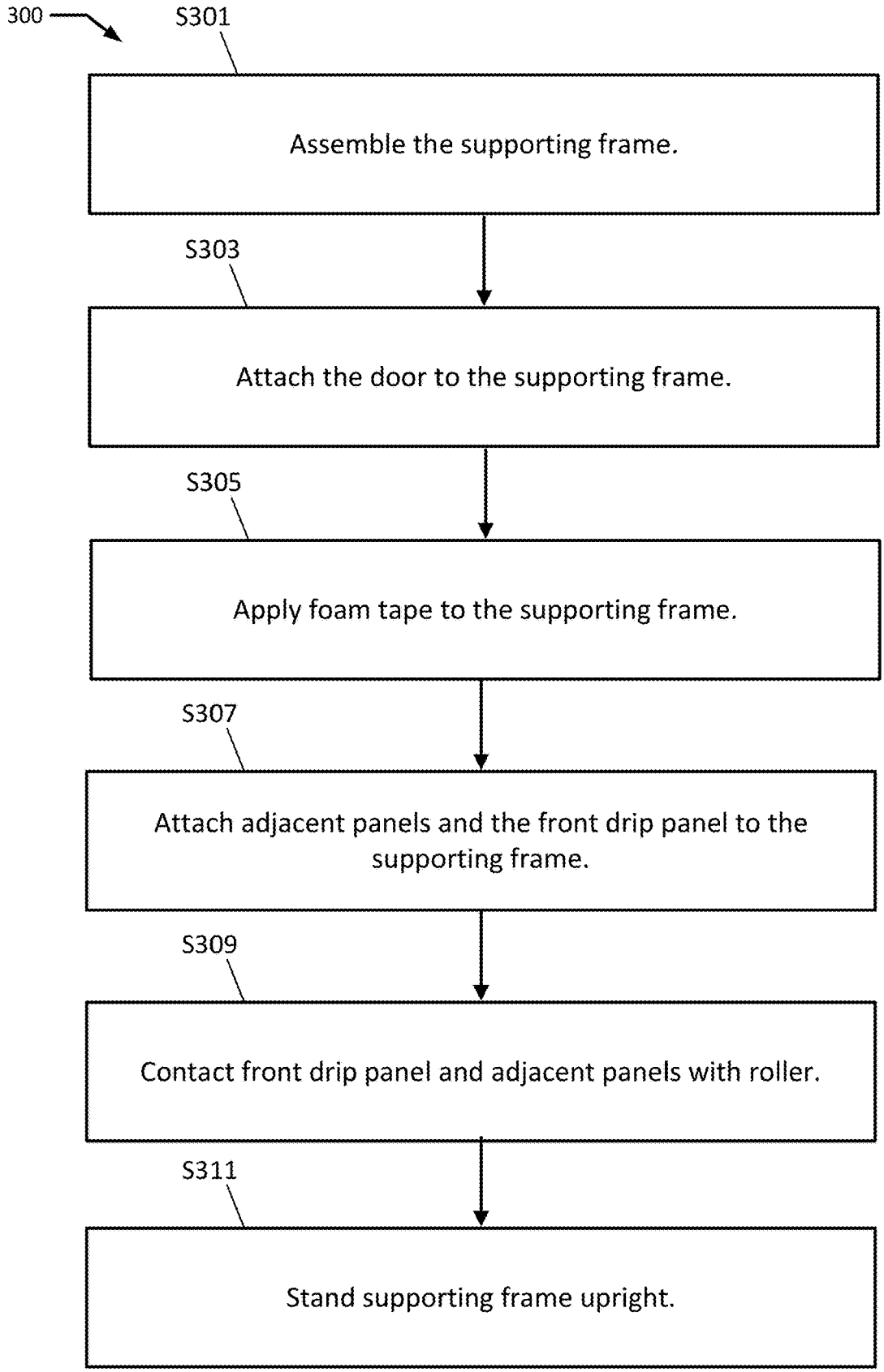
FIG. 13 illustrates a flow chart for assembling a generator enclosure including a panel with integrated flashing according to another example.

FIG. 13 illustrates a flow chart 300 for assembling a generator enclosure 100 including a front drip panel 101 with integrated flashing 102 according to a second example of the present disclosure. The flow chart 300 may be used to assemble a generator enclosure 100 according to the various examples of the present disclosure. Additional, different, or fewer acts may be provided.

In a first act S301, the supporting frame 120 may be assembled. At act S301, the plurality of columns 121 and beams 122 comprising the supporting frame 120 may be attached or connected to one another. In some examples, at act S301 individual walls of the supporting frame 120 may be assembled. For examples, columns 121 and beams forming a single wall of the generator enclosure may be attached to connected to one another. At act S301, the columns 121 and beams 122 comprising the supporting frame 120 may be welded to one another, attached or connected to one another using an adhesive such as foam tape, and/or attached or connected to one another using fasteners. Further, in act S301, one or more of a door frame 104, a window frame 106, and/or a vent frame 108 may be attached or connected to the supporting frame 120.

In a second act S303, a door 103, window 105, and/or vent assembly may be attached or secured to the supporting frame 120. Specifically, a door 103 may be attached or secured to a door frame 104 of the supporting frame 120, a window 105 may be attached or secured to a window frame 106 of the supporting frame 120, and/or a vent assembly may be attached or secured to a vent frame 108 of the supporting frame 120. In some examples, the door 103, window 105, and/or vent assembly may be attached or secured to the supporting frame 120 or a portion of the supporting frame that is laying horizontally (e.g., on a floor, the ground); in these examples, the door 103, window 105, and/or vent assembly may be placed on a horizontal plane before being attached or secured to the frame assembly.

In a third act S305, foam tape 140 may be applied to the supporting frame 120. In some examples, at act S305, the walls of the supporting frame 120 may be separate from one another and may be laid on a horizontal surface such as a floor or the ground. In other examples, at act S305, the supporting frame 120 may be fully assembled and the walls of the supporting frame may stand vertically. At act S305 foam tape 140 is applied to the supporting frame 120. Specifically, foam tape 140 may be applied to an outer surface of columns 121 and/or beams 122 forming the supporting frame 120. In some examples, foam tape 140 may be applied to a top surface and/or an exterior surface of a door frame 104, window frame 106, and/or vent frame 108 disposed or attached to the supporting frame 120.

In a fourth act S307, the adjacent panels 115 and/or one or more front drip panels 101 are attached or secured to the supporting frame 120. Specifically, the adjacent panels 115 and/or front drip panel(s) 101 may be placed on the supporting frame 120 so as to contact the foam tape 140 applied to the supporting frame 120. In some examples, the adjacent panels 115 may be attached or secured to the supporting frame 120 before the front drip panel(s) 101. In some examples, for example, when a front drip panel 101 overlaps one or more adjacent panels 115, additional foam tape 140 may be applied to the portion of the exterior surface of the one or more adjacent panels that will be overlapped by the front drip panel(s). The overlapping front drip panel(s) 101 may then be attached or secured to the adjacent panels 115 and/or the supporting frame 120.

In a fifth act S309, the front drip panel(s) and adjacent panels 115 may be contacted by a roller or another mechanical device (e.g., plate, etc.). The roller or other mechanical device may apply a force to the front drip panel(s) and/or adjacent panels 115 in the direction of the supporting frame 120. A force applied by the roller or mechanical device may ensure and/or strengthen a bond between the supporting frame 120, foam tape 140, and the front drip panel(s) 101 and/or adjacent panels 115.

In a sixth act S311, the supporting frame including the front drip panel(s) 101, adjacent panels 115, and door 103, window 105, and/or vent assembly may be stood upright. Further, in some examples, in act S311, one or more walls of the supporting frame 120 may be attached or connected to one another after being stood upright.

Referring generally to the figures, in some examples, the generator enclosure 100 houses an engine-generator. Referring to FIGS. 1-3, the generator enclosure 100 may be mounted on a fuel tank 110 configured to store fuel for an engine-generator within the generator enclosure 100. An engine-generator housed by the generator enclosure 100 may include an engine and an alternator. The engine may include one or more mounts for securing the engine to the fuel tank 110 and/or the generator enclosure 100. The alternator may include one or more mounts for securing the alternator to the fuel tank 110 and/or the generator enclosure 100. The engine and alternator may be mounted on top of the fuel tank 110. The engine and the alternator may be coupled to one another. The engine may be an internal combustion engine. The engine may include components such as crankshaft, flywheel, muffler, air cleaning system, and a control portion. The engine may be a two-stroke engine or a four-stroke engine. The number of cylinders of the engine may vary to include one cylinder or multiple cylinders. The size of the engine may vary depending on the application.

The engine may be any type of engine in which the combustion of a fuel (e.g., gasoline or another liquid fuel) with an oxidizer (e.g., air) in a chamber applies a force to a drive component (e.g., piston, turbine, or another component) of the engine. The engine may receive fuel from the fuel tank 110. A spicket outlet may extend upward from the fuel tank 110 and be fluidly connected to the engine to supply fuel to the engine. The drive component rotates to turn a drive shaft. The combustion air for the engine is brought in through the combustion air inlet. The engine may further include a radiator. The radiator may cool the engine. The engine may include an electrical fan or a fan connected to the drive shaft. The fan may be configured to draw air into the generator enclosure and/or through the radiator.

The drive shaft of the engine may be connected to the alternator. An alternator housing encompasses the alternator. The alternator housing connects to the engine on one end. In some examples, on the other end the alternator housing connects to the generator enclosure 100. The alternator is operated by rotation of the drive shaft to turn the alternator and produce electric output. In some examples, the generator enclosure 100 may include a top access opening 130. The top access opening 130 may be configured to receive one or more electric cables carrying current generated by the alternator. The one or more electric cables carrying current generated by the alternator may extend through the top access opening 130. In other examples, the generator enclosure 100 may include a circuit breaker rack 131. The circuit breaker rack 131 may be attached or secured to the generator enclosure 100 (e.g., vertical columns 121) and configured to support one or more circuit breakers electrically connected to the engine generator. In some examples, the fuel tank 110 may extend through a channel extending through the fuel tank 110 located below the circuit breaker rack 131. The channel extending through the fuel tank 110 may be disposed within a perimeter of the fuel tank 110 but is not fluidly connected to the interior of the fuel tank 110. The one or more electric cables may connect the engine-generator to a transfer switch.

The phrases "coupled with" or "coupled to" include directly connected to or indirectly connected through one or more intermediate components. Additional, different, or fewer components may be provided. Additional, different, or fewer components may be included.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A generator enclosure for an engine-generator, the generator enclosure comprising:

a door frame; and an enclosure panel with unitary formed flashing having a first vertical portion, a second vertical portion, and a horizontal portion extending from the first vertical portion to the second vertical portion, wherein the horizontal portion abuts the door frame, and the second vertical portion extends from a top portion of the door frame.

2. The generator enclosure of claim 1, further comprising:

a foam tape coupled to the enclosure panel with integrated flashing.

3. The generator enclosure of claim 1, further comprising:

a plurality of adjacent panels, wherein at least one of the plurality of adjacent panels is adjacent to the door frame and the enclosure panel with integrated flashing.

4. The generator enclosure of claim 3, wherein the enclosure panel with integrated flashing overlaps the at least one of the plurality of adjacent panels.

5. The generator enclosure of claim 3, further comprising:

a first piece of foam tape coupled to the enclosure panel with integrated flashing and a second piece of foam tape coupled to the at least one of the plurality of adjacent panels.

6. The generator enclosure of claim 1, wherein a length of the first vertical portion is longer than a sum of a length of the horizontal portion and a length of the second vertical portion.

7. The generator enclosure of claim 1, wherein the second vertical portion abuts the door frame.

8. The generator enclosure of claim 1, wherein an angle measured from a horizontal plane as a positive angle of the horizontal portion above the horizontal plane as the horizontal portion meets the first vertical portion is greater than 0 degrees.

9. The generator enclosure of claim 1, wherein an angle measured from a horizontal plane as a positive angle of the horizontal portion above the horizontal plane as the horizontal portion meets the first vertical portion is in a range of five degrees to 20 degrees.

10. The generator enclosure of claim 1, further comprising:

a foam tape coupled to a bottom surface of the horizontal portion.

11. A generator enclosure for engine-generator, the generator enclosure comprising:

a supporting frame including a plurality of vertical columns, a plurality of horizontal beams, and a door frame; and an enclosure panel with unitary formed flashing having a first vertical portion, a second vertical portion, and a horizontal portion extending from the first vertical portion to the second vertical portion, wherein the horizontal portion abuts the door frame and the second vertical portion extends from a top portion of the door frame.

12. The generator enclosure of claim 11, wherein at least one of the plurality of vertical columns is parallel to the first vertical portion of the enclosure panel with integrated flashing and extends behind the enclosure panel with integrated flashing and the door frame.

13. The generator enclosure of claim 11, further comprising:

a plurality of adjacent panels, wherein at least one of the plurality of adjacent panels is adjacent to the door frame and the enclosure panel with integrated flashing.

14. The generator enclosure of claim 13, wherein the enclosure panel with integrated flashing overlaps the at least one of the plurality of adjacent panels.

15. The generator enclosure of claim 14, further comprising:

a first piece of foam tape coupling one of the plurality of adjacent panels to one of the plurality of vertical columns; and a second piece of foam tape coupling the enclosure panel with integrated flashing to at least one of one of the plurality of adjacent panels and one of the plurality of vertical columns.

* * * * *